US005255798A

United States Patent [19]

Aaldenberg et al.

[11] Patent Number: 5,255,798

[45] Date of Patent: Oct. 26, 1993

[54] ADJUSTABLE SUSPENSION SYSTEM FOR HANGING FOLDERS AND PACKAGE THEREFOR

[75] Inventors: Eric R. Aaldenberg, Bayside; Andrew H. Wertheim, Old Bethpage; Theodore V. Kachel, Purchase, all of N.Y.; Jonathan B. Rivlin, East Brunswick, N.J.

[73] Assignee: Esselte Pendaflex Corporation, Garden City, N.Y.

[21] Appl. No.: 927,095

[22] Filed: Aug. 7, 1992

[51] Int. Cl.[5] ..... A47F 5/00

[52] U.S. Cl. ..... 211/46; 312/184

[58] Field of Search ..... 211/46, 45, 189, 175; 312/184

[56] References Cited

U.S. PATENT DOCUMENTS

| | | | |
|---|---|---|---|
| 670,789 | 3/1901 | Kroder . | |
| 2,852,028 | 9/1958 | Patterson et al. | 129/16 |
| 3,848,748 | 11/1974 | Ceccarelli | 211/178 R |
| 3,999,663 | 12/1976 | Walter et al. | 211/175 |
| 4,030,610 | 6/1977 | Alexander | 211/182 |
| 4,295,571 | 10/1981 | Meyer | 211/200 |
| 4,526,277 | 7/1985 | Snowden et al. | 211/46 |
| 4,765,490 | 8/1988 | Hanson | 211/46 |
| 4,901,867 | 2/1990 | Petty, Jr. | 211/46 |

FOREIGN PATENT DOCUMENTS 1091119 9/1980 Canada .

*Primary Examiner*—Alvin C. Chin-Shue
*Assistant Examiner*—Sarah A. Lechok
*Attorney, Agent, or Firm*—Pennie & Edmonds

[57] ABSTRACT

A hanging folder suspension system for use with different sizes of file cabinets and different sizes of hanging folders and which is suitable for compact storage. The system includes a frame which is made of a pair of frame elements which have a column member and at least one horizontal bracket member and is integrally made of reinforced plastic. The frame elements can be locked together in a laterally adjustable manner to accommodate different size folders. A pair of multi-component rails which are adjustable to the length of the file cabinet are provided and engage rail positioning channels in the frame elements to secure the rails into the frame and form an upright rigid structure in a working position. The rails include at least two rail elements which are joined by a connecting bracket. When disassembled, the frame and rail elements fit into a compact storage box suitable for handling by standard processing facilities.

40 Claims, 6 Drawing Sheets

ADJUSTABLE SUSPENSION SYSTEM FOR HANGING FOLDERS AND PACKAGE THEREFOR

FIELD OF THE INVENTION

The present invention relates to a suspension system for hanging file folders and includes adjustable end frames, which can be used for different size of hanging folders in different sizes of drawers or file cabinets, and adjustable, multi-piece rails for use with the frames. These frames and rails are suitable for compact storage and shipment in a package.

BACKGROUND

Hanging file folder frames are an essential part of modern document organization systems, providing efficient storage and convenient access to documents placed in vertically arranged pocket-type hanging file folders. To be of practical value, a hanging folder frame must be inexpensive to make and easy to assemble, and have a strong and rigid structure. In addition, given the diversity of sizes of file folders and storage cabinets or drawers currently in use, it is very important that the frames and rails provide both lateral and longitudinal adjustability in order to meet the requirements of various different office settings.

A number of solutions have been proposed in the past to meet these often contradictory requirements. Some approaches focus on lateral adjustability of the hanging folder frame in order to accommodate different folder sizes. One way to achieve this involves telescopic horizontal cross-members extendible to different positions, as shown bY U.S. Pat. No. 3,999,663. In this arrangement, the frames are relatively complex, making them costly and awkward to adjust. In addition, although providing the desired adjustability, the frames designed according to this approach are structurally weak.

Other known solutions involve invertible assemblies, one end of which is adjusted to accommodate one type of folders, for instance letter size, while the inverted frame is adjusted to accommodate a different type of folders, frequently legal size document folders. The end frames according to this approach have a rigid structure as in U.S. Pat. No. 4,526,277, or can be of an X-shaped configuration, as in U.S. Pat. No. 4,295,571, both frames supporting letter and legal size folders. In each case, the proposed structure only has limited lateral adjustability (two options) and cannot be used in a more general setting. Also, the assembly of the X-shaped frames involves loose hardware and is complicated.

Other known hanging folder frames are designed in search of compactness of the overall structure by means of removable vertical support mountings. An example is described in U.S. Pat. No. 3,848,748, wherein the vertical mountings are rotationally connected to fixed size upper and lower frames by means of hooks. The vertical support mountings can be folded and collapsed to occupy minimum space in one dimension. The upper and lower frames, however, are of fixed dimensions, corresponding to the maximum width and length of the supported file cabinets. Thus, by necessity, any package containing these components will be quite large in at least one dimension.

Due to the requirement of rigidity of the support rails, only relatively few known solutions provide longitudinal adjustability of the hanging folder frame and an associated compact storage feature of the disassembled structure. Adjustability of the rail length is typically achieved by means of weakened notch regions located at the end portions of the support rails, which weakened regions can be broken away to obtain the desired length of the rails (U.S. Pat. No. 3,999,663). While providing the desired adjustability in length, this approach still has the disadvantage of requiring a packaging box of the largest possible dimensions, which makes shipping, handling and storage inconvenient and costly. In addition, once adjusted to a specific size, frames of this type cannot properly be readjusted to exploit the full capacity of larger size file cabinets.

Longitudinal adjustability is the object of another type of hanging folder frames, as exemplified by U.S. Pat. No. 2,852,028, where one rail element is adjustably sliding in a channel, and is secured to a second rail element of much shorter length. As in the previous case, however, the storage box by necessity must have at least one relatively large dimension. Also, the assembly of the frame may is complicated.

Thus, no currently used hanging folder system provides easy to assemble components, adjustability in two dimensions (i.e., width and depth), and a structure which facilitates compact packaging and storage.

SUMMARY OF THE INVENTION

The present invention provides a new and unexpected solution to these problems in a laterally adjustable frame for supporting a pair of support rails upon which hanging folders may be suspended. The frame comprises first and second frame elements each having a column member and at least one substantially horizontal bracket member extending away from the column member, means for positioning a pair of support rails at a height which enables suspension of file folders thereon, and means for adjustably connecting the first and second bracket members to position the column members in a spaced relation corresponding to a predetermined adjustable distance between the support rails positioning means.

The adjustable connecting means preferably comprises a plurality of apertures positioned in spaced relation along a horizontal bracket member of one frame element and a plurality of locking elements positioned along a horizontal bracket member of the other frame element. The locking elements are positioned in spaced relation corresponding to the spaced relation of the apertures and at least two locking elements engage two corresponding apertures to join the first and second frame elements to form the frame.

The locking elements generally include a first portion which is secured to the horizontal bracket member, and a second portion which is secured to the first portion, with the second portion having at least one dimension which is larger than that of the first portion. Thus, the larger dimension of the second portion of the locking elements can pass into and engage the aperture.

Advantageously, each of the apertures is configured to have a first opening which receives both the first and second portions of the locking elements, and a second opening which has at least one dimension that is smaller than the second portions of the locking elements. To achieve this arrangement, the first opening of each aperture may be substantially circular while the second opening may be an elongated slot, such that the second portion of the locking elements can pass through the first opening but will be retained by the slot behind the bracket member. Thus, the first and second portions of the locking means are inserted substantially perpendicularly into the first opening and the second portion is placed into the second opening by relative linear movement of the bracket members.

Each bracket member preferably includes an elongated wall member having opposed ends and side portions and a flange member extending from each side portion, with one end of the wall member secured to the column member. If desired, the frame may further include registration means for retaining the position of one horizontal bracket member with respect to the other in a predetermined spatial relation, such as a raised area associated with one of the horizontal bracket members, and a plurality of recesses associated with the other horizontal bracket member, with the raised area capable of selectively engaging the recesses to provide different relative spatial positions of the column members.

In another embodiment, each of the frame elements comprises a second substantially horizontal bracket member extending away from the column member and arranged in parallel spaced relation to the first bracket member for imparting increased rigidity to the connection of the frame elements. The first horizontal bracket member is usually positioned at an upper end of the column member with the second horizontal bracket member usuallY positioned at a lower end of the column member. Thus, the frame may also have means operatively associated with the adjustable connecting means for releasably locking the second bracket members together, such means being similar to those described above for locking the first bracket members together.

Advantageously, the bracket member and column member of each frame element are integrally formed and made of a plastic material. Also, each column member may be provided with one or more reinforcing ribs for additional strength and rigidity.

The support rail positioning means comprises a channel located at an upper portion of the column member, which channel has a length sufficient to retain a support rail in a substantially horizontal position when one end of the support rail is received by the channel. Each channel has an open end and a closed end so that one end of the support rail passes through the open end of the channel and is positioned adjacent the closed end.

Another embodiment of the invention relates to a suspension system for hanging file folders which comprises first and second laterally adjustable frames each constructed as described above and a pair of support rails each having first and second ends, wherein the first ends of the rails are retained in the positioning means of the first frame and the second ends of the rails are retained in the positioning means of the second frame.

Preferably, each of the support rails is made of at least two rail elements, each substantially shorter than the total desired length of the support rail and having a first end, a second end and elongated sides. A rail element connecting bracket and means for joining the second ends of the rail elements to the connecting bracket are used to form the support rails. The joining means comprises a recess and a recess engaging component, wherein the recess is associated with one of the connecting bracket or the second end of the rail element, and the recess engaging component is associated with the other to form a support rail having a top surface which allows sliding movement of the suspended file folders.

The connecting bracket generally has a pair of spaced elongated side walls attached by a base portion and retained in a substantially parallel arrangement for receiving the second ends of the rail elements in contact relation with a portion of the sides of the rail elements.

The side walls of the connecting bracket advantageously include a ramp portion on each end thereof to facilitate sliding movement of the hanging file folders thereover in either direction without substantial obstruction. The second ends of the rail elements are retained in adjacent relation in linear alignment in the connecting bracket, with each second end of the rail elements preferably having an arm portion which extends toward the other rail element for mating engagement therewith to strengthen the support rail.

In one arrangement, each of the second ends of the rail elements includes a recess and one of the side walls of the connecting bracket includes a pair of spaced recess engaging components for lockingly engaging the recesses of the rail elements. The connecting bracket may also include an additional base portion for attaching the side walls together in the form of a sleeve. Thus, the connecting bracket can be made of a single sheet of material which is shaped to have the desired configuration and the ends of which are joined for structural rigidity.

In another arrangement, the connecting bracket is releasably engagable with the second ends of the rail elements and is positioned so that the hanging file folders slide upon the base portion of the connecting bracket. Here, the recess in each of the second ends of the rail elements may be an aperture and each recess engaging component a fastener so that the rail elements can pivot with respect to the connecting bracket. The side walls of the connecting bracket can be provided with a length which is greater than the length of the base portion so that the fasteners can be located in the side walls at a point beyond the length of the base portion. This provides the connecting bracket with means to prevent rotation of the rail elements beyond about 90 degrees with respect to the connecting bracket.

Further, the connecting bracket may be releasably engagable with the second ends of the rail elements and positioned so that the hanging file folders slide upon the side walls of the connecting bracket and not upon the base portion. In any of the preceding embodiments, one of the ends of each rail elements (or support rail) has at least one notch region for adjusting the length of the support rail.

Another aspect of the invention relates to a combination comprising the suspension system described above and a package for shipping the suspension system. The package has a length, width and height each of which is less than about one-half the length of a conventional hanging folder support rail because the frame elements are enclosed in the box as components rather than as the final rails. Thus, the length and width of the package, when multiplied, result in an area which is less than about 35% of that of a suspension system package which contains conventional support rails.

In this package, the frames include means for receiving and storing the rail elements on the frame elements. Thus, the frame elements receive and store the support rails along a diagonal direction between the length and width of the package. To minimize the package size, the rail element connecting bracket may be permanently mounted on the second end of one of the rail elements and the length of the rail element with the mounted bracket member is then made to be substantially the same length as the other rail element.

BRIEF DESCRIPTION OF THE DRAWINGS

For the purposes of promoting an understanding of the principles of this invention, reference will now be made to the, preferred embodiments illustrated in the drawin /wherein.

DETAILED DESCRIPTION OF THE INVENTION

Figure 1:
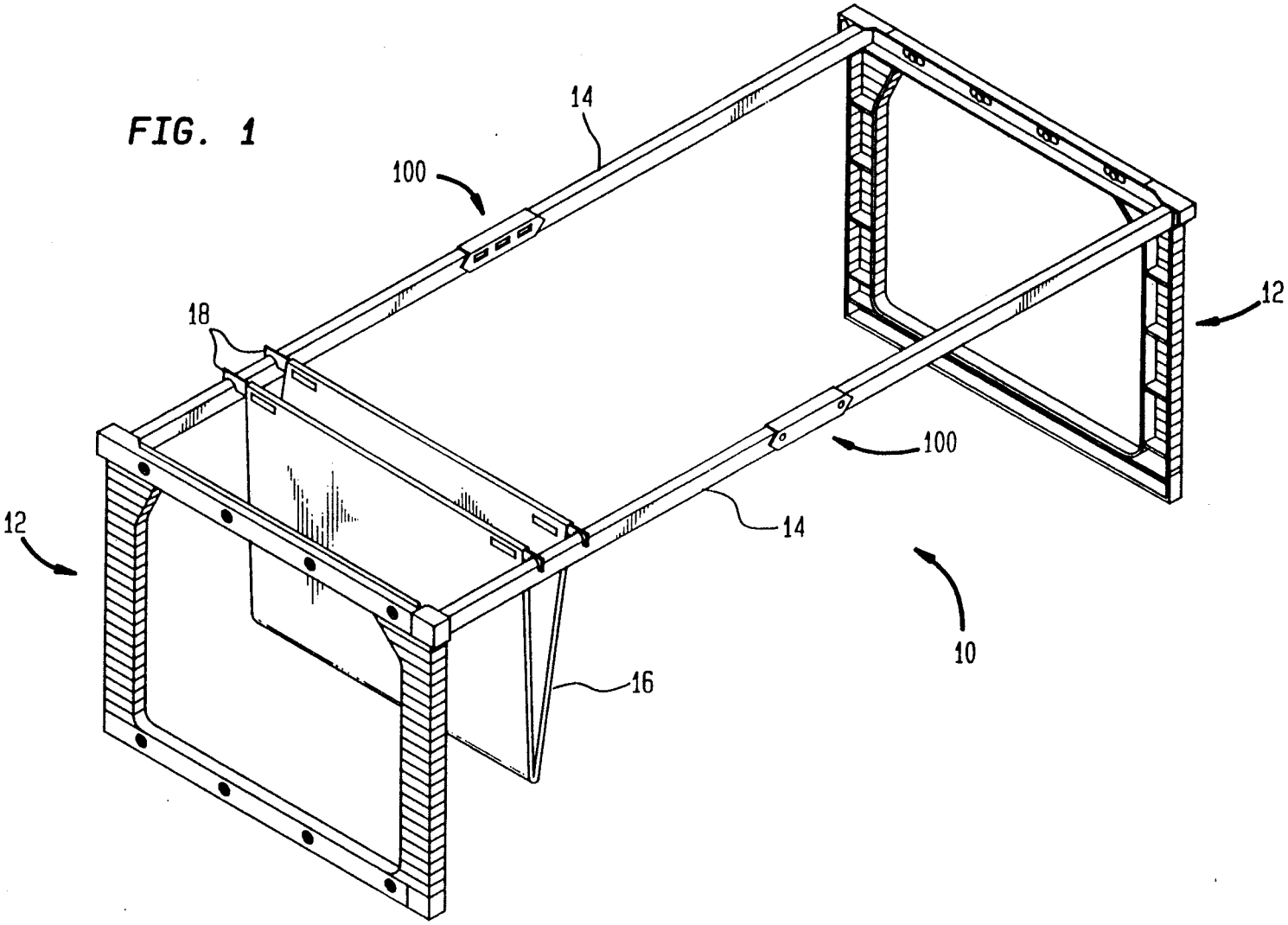
FIG. 1 is a perspective view of the assembled suspension system of the present invention.
Figure 2:
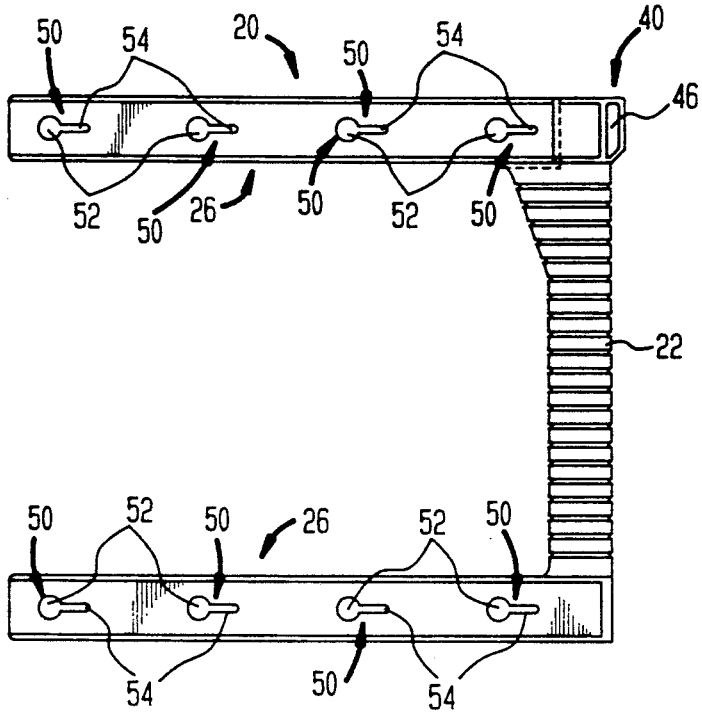
FIGS. 2-7 are isometric views of a first embodiment of a frame element which is used to form the frame of the system of FIG. 1, with FIG. 2 being a front view, FIG. 3 a right side view, FIG. 4 a top view, FIG. 5 a are view, FIG. 6 a left side view, and FIG. 7 a bottom/-view.
Figure 3:
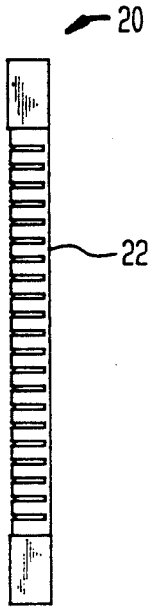
Figure 4:
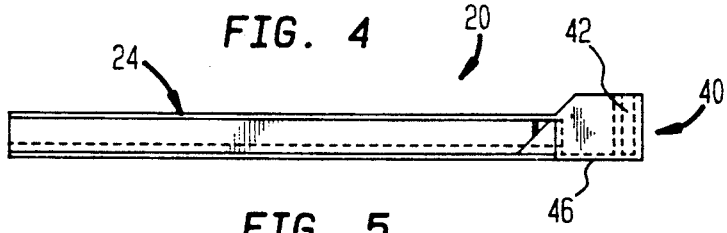
Figure 5:
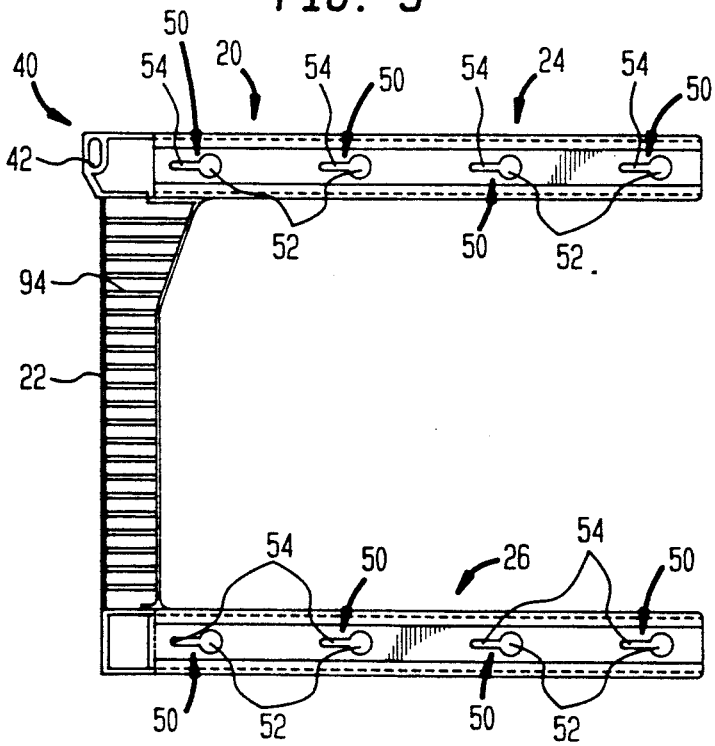
Figure 6:
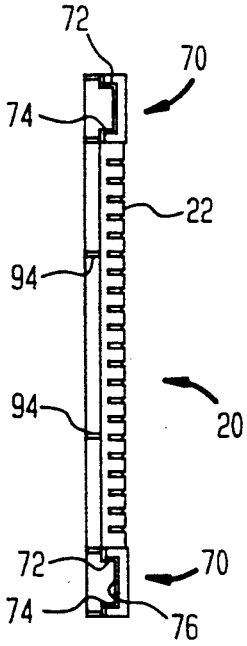
Figure 7:
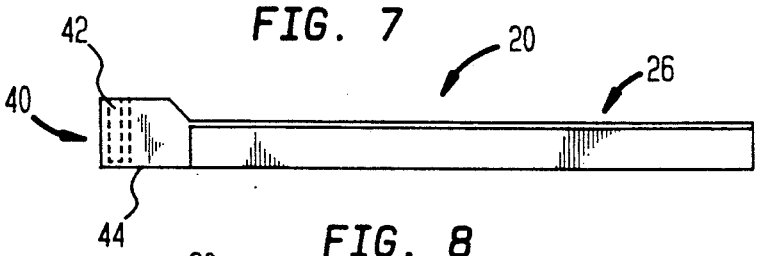
Figure 8:
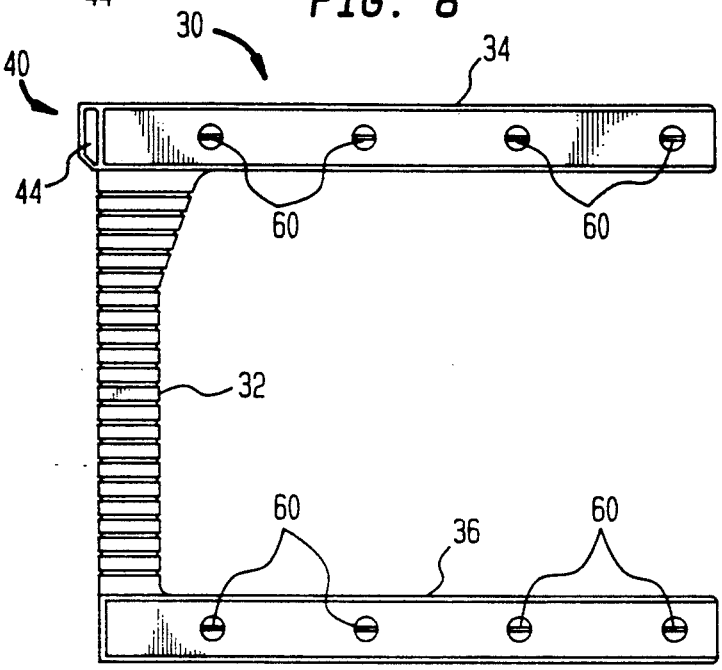
FIGS. 8-11 are isometric views of a corresponding frame element which is used to join with the frame element of FIGS. 2-7 to form the frame of the s of FIG. 1, with FIG. 8 being a front view, FIG. right side view, FIG. 10 a rear view, and FIG. 1 left side view.
Figure 9:
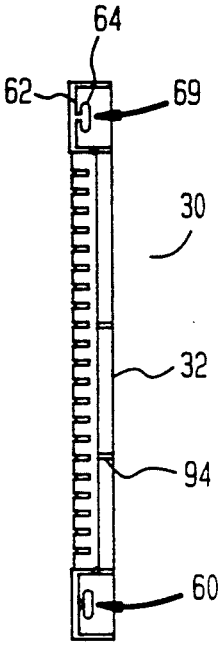
Figure 10:
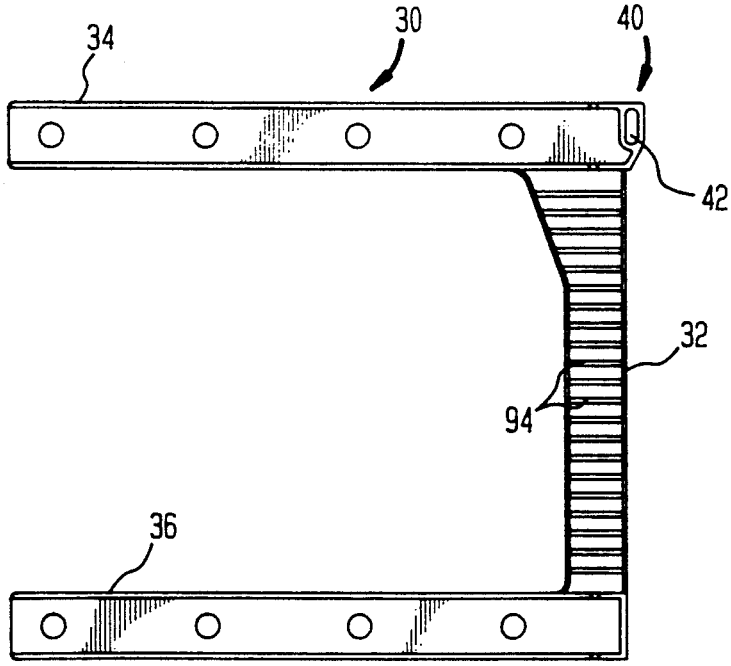
Figure 11:
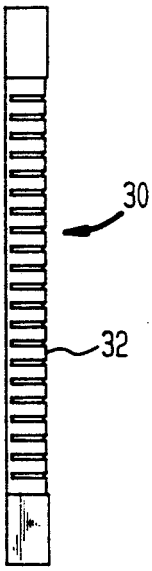
Figure 12:
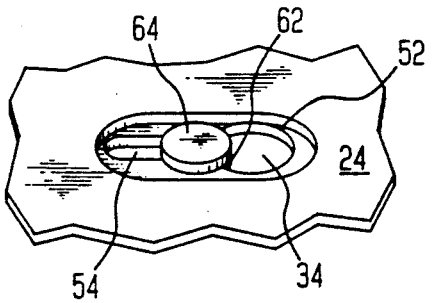
FIG. 12 is a partial perspective view of a locking element of one frame element engaging an aperture of the other frame element for locking engagement of the frame elements.
Figure 13:
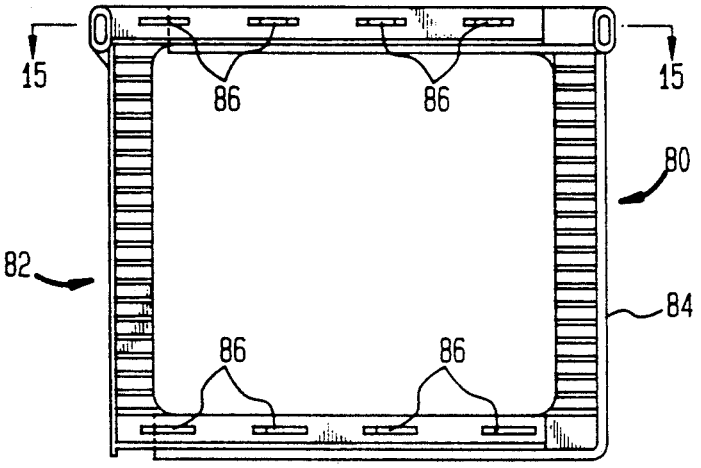
FIG. 13 is a front view of a second embodiment of a frame which is made of frame elements which are different from those of FIGS. 2-11.

Referring initially to FIG. 1, there is illustrated a hanging folder suspension system 10 comprising two identical end frames 12 and a pair of substantially identical support rails 14 according to the invention in a working position for supporting one or a plurality of hanging file folders 16 thereon. The support rails 14 are insertably mounted parallel to each other in a pre-specified spatial relation at an upper end of the frames at a height enabling the proper suspension of hanging file folders 16. During use, the hanging file folders 16 are hung by means of end hooks 18 which engage the support rails 14, and can slide along the rails to provide document organization and access.

Referring now to FIGS. 2-11, each frame 12 comprises two frame elements. One frame element 20, shown in FIGS. 2-7, has a column member 22 and at least one substantially horizontal member 24 extending away from the column member 22. For improved rigidity of the frame, each frame element advantageously includes a second horizontal bracket member 26, which is substantially identical to the first bracket member 24 and disposed below it at the lower end of the column member 22.

FIGS. 8-11 show a second frame element 30 including a column member 32 and first and second horizontal bracket members 34, 36 which matingly engages the horizontal bracket members 24, 26 of the first frame element 20.

The uppermost end of the column member 22, 32 of each frame element is provided with rail-positioning means 40 for mounting the support rails 14. According to the invention, each rail-positioning means 40 comprises a receiving channel 42 formed in the top portion of the respective column member 22, 32 at a height which enables the suspension of the file folders 16. The receiving channel 42 has a receiving depth which terminates in a rear wall 44 and is of a length sufficient to retain one end of a support rail 14 in a substantially horizontal position therein. Preferably, this depth is about 1 cm. Receiving channel 42 also should advantageously provide a sliding and progressively frictional snug fit with the end of the support rail 14.

The frame elements 20, 30 are provided with means for adjustably connecting the horizontal bracket members 24, 26 of the first frame element 20 to the horizontal bracket members 34, 36 of the second frame element 30. The adjustable connection means allows the column members 22, 32 of the two frame elements to be positioned in a desired spaced relation, which corresponds to a predetermined adjustable distance between the rail positioning means 40. This adjustable connecting means comprises a plurality of spaced apertures 50, positioned along the horizontal bracket members 24, 26 of frame element 20 and a plurality of correspondingly spaced locking elements 60, positioned along the horizontal bracket members 34, 36 of the other frame element 30.

According to the invention, the apertures include a first opening 52 of a substantially circular shape, and a second opening which has an elongated slot- like shape. The locking elements 60 comprise first and second neck portions 62, secured to the horizontal bracket member and a head portion 64 having at least one larger dimension than the neck portions 62 and being integral therewith. The head portion 64 is spaced from the respective bracket member 34, 36 by a length which approximately corresponds to the depth of the apertures 50 of the other bracket members 24, 26. Also, the first opening 52 is dimensioned to receive both the head and neck portions of the locking elements 60, while the second opening 54 is smaller than the head portion 64 but larger than the neck portion 62.

In its working position, the locking elements 60 are adapted to lockingly engage at least two of the apertures 50, positioned on the respective bracket members 24, 26. Generally, at least three of the four apertures shown are engaged by the locking elements 60. The locking elements are placed into the first openings 52, and the head 64 and neck 62 portions are slid linearly to engage the neck portions into the second openings 54 of the apertures 50. The connecting means thus reduces the degrees of freedom of the relative motion between the two frame elements 20, 30, thus enabling uncoupling in only one linear direction.

To provide additional strength of the interlocked connection of the frame elements 20, 30 and to increase the rigidity of the frame 10, the horizontal bracket members 24, 26, 34, 36 each have a substantially U-shaped cross-section 70 which includes two flange portions 72, 74 integrally secured at a substantially right angle to an elongated wall portion 76. The horizontal bracket members of one frame element, e.g. 20, have an inner distance between the flange portions 72, 74, which correspond to width of the elongated wall portion of the horizontal bracket members of the other frame element 30. When assembled, the horizontal bracket members of one frame element are inserted into the horizontal bracket members of the other. This connection increases the rigidity of the frame 12, particularly against vertically acting forces.

The design of the frame elements 20, 30, in conjunction with the connecting means provides in a working position only one degree of freedom in the relative motion of the engaged bracket members. This relative motion is constrained to the horizontal direction and is further restricted by the length of the apertures 50 and distance between the neck portion 62 of the locking elements 60. During use, this motion will not exceed the length of the suspending hooks of the file folders, thus providing the desired lateral spacing of the support rails 14.

FIGS. 13-16 illustrate another frame 80 composed of frame elements 82, 84 which are similar to frame elements 20, 30 with the main difference being the design of the horizontal bracket connecting means. In this frame 80, the connecting means include apertures 86 in the shape of an elongated slot. The locking elements 88 are hooks which are configured to pass through the slots 86 with the hooks engaging the bracket at the end of the slot 86 to form a secure connection.

Figure 14B:
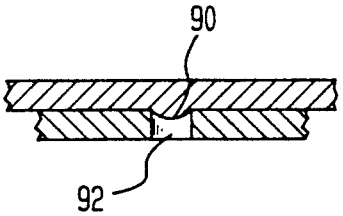
FIG. 14 is a cross-sectional view of the horizontal racket members of the frame of FIG. 13 taken along lines 14—14 illustrating the frame in position for forming a suspension frame for letter size hanging folders.
FIG. 14A is a partial side view illustrating the registration means which is used to align the frame elements.
Figure 14A:
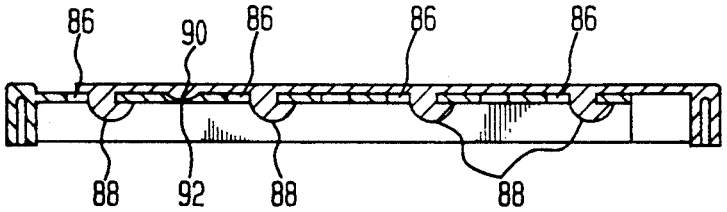
Figure 15:
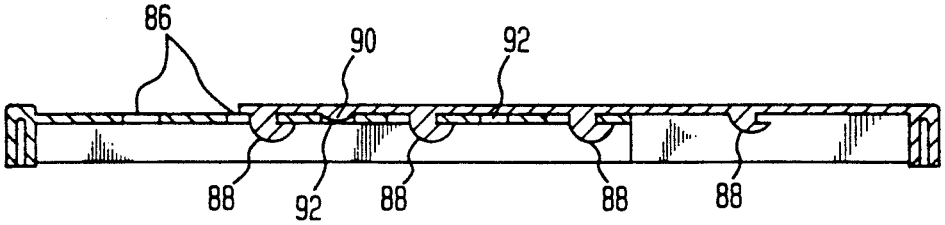
FIG. 15 illustrates the frame of FIG. 14 in position for forming a suspension frame for legal size hanging folders.

FIGS. 14 and 15 show two different such locking connections between the frame elements 82 and 84 adjusted for use of the hanging folder frame for two different size file folders (e.g., letter and legal size). Also, although these bracket members are preferred to be horizontal, it is also possible for these brackets to have different configurations so long as at least a portion is substantially horizontal for engaging the corresponding bracket element of the corresponding frame element .

In some applications it may be desirable to further secure the relative position of the column members. According to one embodiment of the invention, as shown in FIGS. 14-15, this feature is achieved by using registration means which comprises a raised portion or dimple 90, integrally formed on one of the horizontal bracket members, and one or more apertures or recesses 92 formed on one horizontal bracket member of the other frame element. The recesses 92 are spaced at distance from each other, corresponding to the desired spacings of the column members. For example, the registration means can be used to secure a desired relative spacing between the rail-positioning means corresponding to the length of letter-size file folders, as shown in FIG. 14 or legal-size file folders, as shown in FIG. 15.

According to the invention, the frame elements are advantageously made integrally of a plastic material. This selection of material allows the design of frames which are aesthetically pleasing, in addition to weighing less and being relatively inexpensive. To increase the structural strength of the frame, the horizontal bracket members are positioned at its uppermost and lowermost ends of the column member. Horizontal reinforcing ribs 94 may be provided on each column member to impart additional strength and rigidity to the frame elements as well as the entire suspension system.

The assembly of the frames in their working position involves the selection of the desired spacing between the rail positioning means of the column members; aligning the horizontal bracket members; inserting the locking elements into the apertures; and sliding the bracket members together to engage the locking elements into the apertures to form the frame. To complete the entire system, a second frame is assembled in the same manner, the rear sides of two frames are placed in a facing relationship and the support rails are connected to the channels of each frame.

Figure 16:
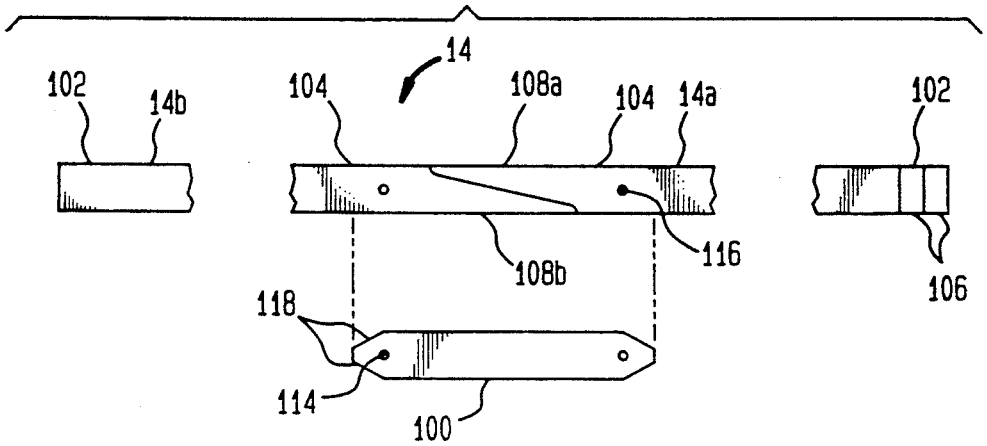
FIG. 16 is a top view of two rail elements positioned in adjacent relation with the connecting bracket positioned alongside.
Figure 17:
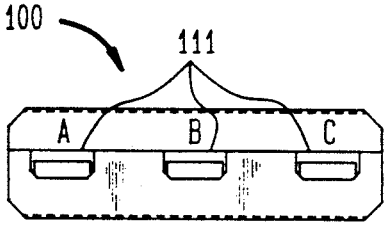
FIGS. 17-20 are isometric views of the rail element connecting bracket of FIG. 16, with FIG. 17 being a front view, FIG. 18 a top view, FIG. 19 a back view and FIG. an end view.
Figure 18:
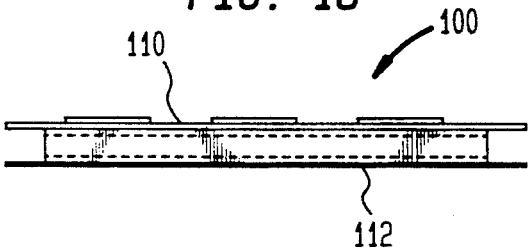
Figure 19:
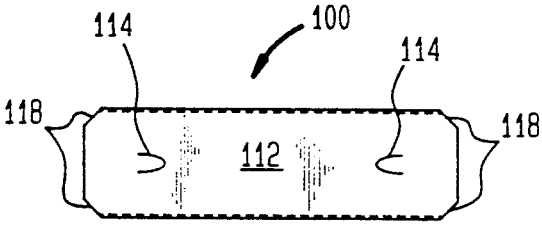
Figure 20:
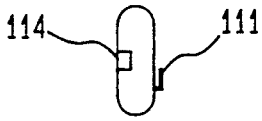

While conventional support rails can be utilized with the frames of this invention, it is advantageous to utilize a multi-piece support rail in order to provide compact storage of the frame in a disassembled position, which is one of the objectives of the present invention. Referring now to FIG. 16, one such rail 14 is shown, having at least two rail elements 14A, 14B and at least one connecting bracket 100. If desired, however, any number of rail elements can be used depending upon the total desired length of the rail. The rail elements are substantially shorter than the total desired length of the support rail 14 and have first ends 102 and second ends 104. For convenience, the rail elements may have substantially the same length. The first ends 102 of the rail elements are designed to slideably and insertably engage the rail-positioning means 40 of the frame elements.

The first end 102 of at least one rail element is in provided with weakened notch regions 106 allowing longitudinal adjustability of the hanging folder suspension system. This adjustability is achieved, after selecting the desired length of the support rails and suspension system, by breaking off a desired number of notch regions.

The second ends 104 of the rail elements are placed within the connecting bracket 100. These ends have arm portions 108A, 108B which matingly engage to provide strength to the connection within the bracket.

According to one embodiment of the invention, as shown in FIGS. 17-20, the connection bracket 100 is made of a single sheet of material shaped into the form of a sleeve. To facilitate automated production of the bracket, the material is bent and then perforated and crimped on one side wall 110 to form joints 111A, 111B, 111C which retain the sleeve in the desired arrangement. The other side wall of the bracket 112 is provided with two spaced tabs 114 which in working position engage apertures 116 which are formed on the second ends 104 of the rail elements to provide a locking connection thereof. According to this embodiment, the second ends 104 of the rail elements are linearly inserted into the ends of the connection bracket until the tabs 114 of the bracket lockingly engage the apertures 116 of the rail elements.

The side walls 110, 112 of the connecting bracket 100 preferably include ramp portions 118 which facilitate sliding movement of the hanging file folders over the connecting bracket in each direction. By providing these ramp portions 118 on each corner of the bracket, the bracket can be mounted on the rail end in any position.

Figure 21:
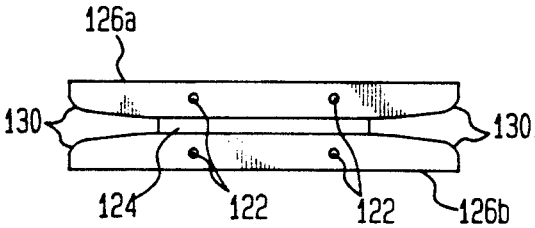
FIG. 21 is a top-view of an alternative embodiment of the rail connecting bracket in a flat preformed position.

FIG. 21 illustrates another embodiment of a connecting bracket 120. This bracket has a U-shape, although, for clarity, it is shown in a flat position prior to being formed into the U shape. The bracket includes a base portion 124 and two side walls 126A, 126B, each of which is provided with a pair of apertures 122. According to this embodiment, the apertures 116 in the second ends 104 of the rail elements are aligned with the apertures 122 of the bracket 120 and are connected by the use of rivets, screws or nuts and bolts. The second ends of the rail elements can be as disclosed above in FIG. 16 or can be configured with flat or slightly contoured ends. The base portion 124 of the connecting bracket is positioned during use on top of the rail elements, so that the hanging folders slide over it. As in the case of the previous embodiment, to facilitate the sliding motion of the hanging-folders, the side walls of the bracket include ramp portions 130 which provide a gradual connection, allowing sliding motion of the hanging file folders in either direction without substantial obstruction.

Figure 22:
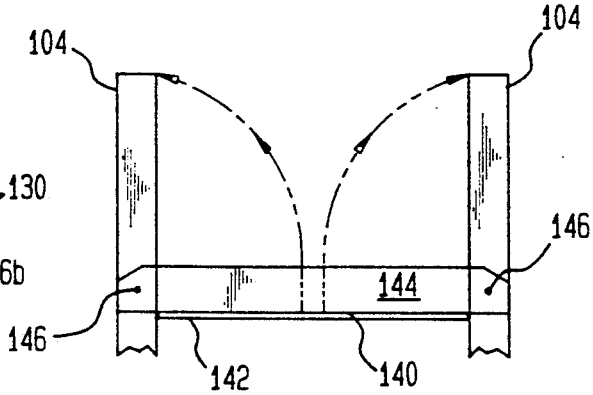
FIG. 22 is a side view of another embodiment of a rail element connecting bracket in combination with two rail elements in a pivoted position.

In FIG. 22, there is illustrated another embodiment of the rail elements connecting bracket 140. According to this embodiment, a U-shaped bracket is again used, having a base portion 142 and two side walls 144, one of which is shown in the FIG. The side walls 144 include apertures 146 for alignment with the apertures of the second ends of the rail elements. These apertures are connected by the use of rivets, screws or nuts and bolts so that the rail elements can pivot about that connection point.

The base portion 142 is positioned during use beneath the rail elements, so that the hanging folders do not slide upon it. In addition, the base portion 142 of the bracket is shorter than the side walls 144, creating a recess adapted to receive the rail elements, when pivoted. In the working position, the rail elements are linearly aligned, their second ends inserted into the U-shaped connecting bracket and secured to the bracket rotationally at distance from their ends approximately equal to half of the length of the bracket. Advantageously, for increased structural rigidity of the support rail, the second ends of the rail elements have mating profiles, with one portion of the rail element extending over the mating portion of the other rail element, as illustrated above in FIG. 16 to distribute vertical bending forces over a larger area. When disassembled, the rail elements, rotate about the pivots, as illustrated in FIG. 22. The length of the slot between the side walls of the connecting bracket determines the maximum angle of folding, as its edge prevents the rail element from further rotation. As an example, if the length of the slot corresponds to half of the width of the rail element, the rail element can be folded at no more than a right angle with respect to the bracket.

When disassembled, according to this embodiment of the support rail, the rail elements and the connecting bracket can be completely disengaged and placed in any suitable position with respect to each other for storage and shipment. The rail can be folded for convenient storage by applying upward directed force below the bracket. This causes the two rotational connections of the bracket with the rail elements to cause the rail elements to pivot, and the whole rail to be folded.

Figure 23:
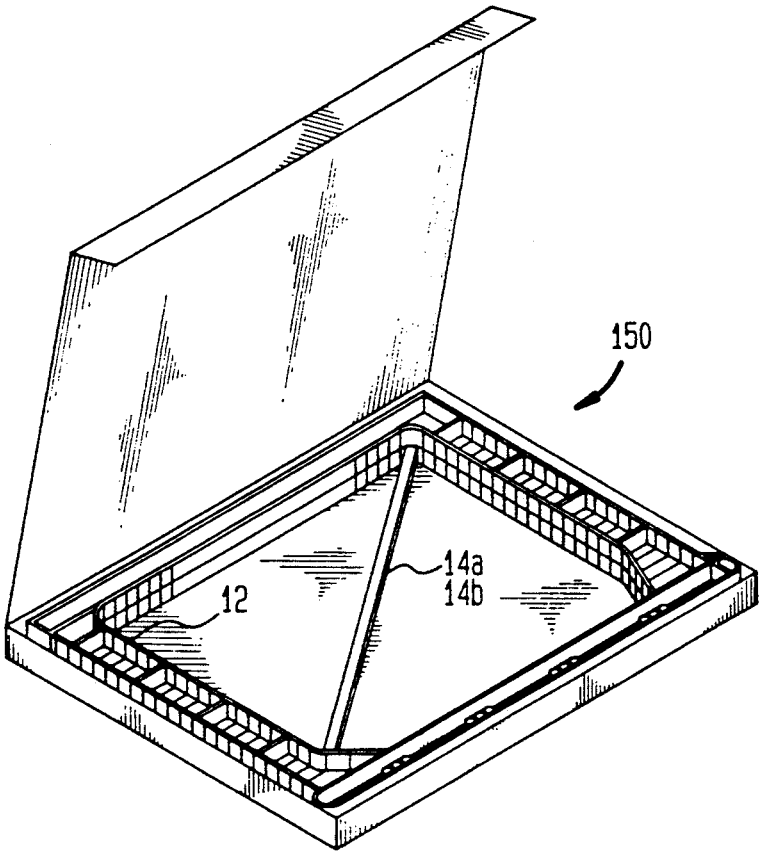
FIG. 23 is a perspective view of a compact package for storing and shipping the suspension system of the invention.

When disassembled, the elements of the suspension system according to the invention fit into a compact storage box 150, as shown in FIG. 23. The two frames are stored either in an assembled manner on top of each other, or disassembled in adjacent relation. One dimension of the storage box is substantially determined by the longer of the column member or the horizontal bracket members. The currently standard dimensions of these elements are approximately 13". Typically, the other dimension of the box is determined by the length of the support rails, currently about 27". To reduce the length of the storage box, some arrangements position the rails diagonally.

According to the invention, the support rails are stored in the box as rail elements. In the embodiment of FIGS. 16–20, the connecting bracket can be separately placed into the storage box, with the rail elements separated. By placing these rail elements diagonally into the box, a relatively compact box having dimensions of about 10" by 12" can be achieved. As shown in FIG. 23, the frames can receive the rail elements for convenient storage.

At the junction points between the column member 22 and the horizontal bracket members 24, 26 of each frame element are positioned rail-receiving means which are used to secure, during storage and shipment, the rail elements in a compact form. A preferred form of these means is an L-shaped pin which is attached to the column member to hold the rail elements onto the frame elements. Other arrangements, such as slots or grooves for receiving the rail elements can be used, if desired.

The length of the rail elements can be adjusted so that the U-shaped bracket may be permanently affixed to one of the rail elements so that the length of one rail element with the bracket is essentially the same as the other rail element. This conserves space and allows the user to more easily assemble the rails.

In the embodiments of FIGS. 21 and 22, the bracket may be stored separately or on the end of one of the rail elements as described above. For the embodiment of FIG. 22, it is also possible to provide the bracket connected to each rail element, when the elements are capable of rotation. The rail elements are then rotated for positioning in the box. When folded in an acute angle (270 degrees is considered a reasonable choice), the support rails can also be positioned diagonally in the box to further minimize the required storage dimensions.

The dimensions of the storage box create a number of advantages for the manufacturers and distributors of the product, including reduced storage space, the possibility to use conventional "Pick'n Pack" equipment, and ultimately lesser cost for shipping, handling and storage. The lesser surface area of the package of the invention may be calculated as 120 square inches compared to 351 square inches for the prior art container. Thus, the present invention provides a reduction in surface area of about 34% for this example. It is expected that reductions in area of as much as 40% to 50% can be achieved for certain sizes. The consumer therefore receives an easy to assemble versatile office product in a less cumbersome to handle package storage box.

After receiving the storage box, the user needs to assemble the two end frames, adjusting the distance between the rail positioning means to correspond to the desired hanging folder width; insert the first ends of the support rails into the corresponding channels of the frames; and adjust the length of the frame to the depth of the file cabinets by breaking off some of the weakened notch regions at the end portions of the rail elements. The procedure requires no additional tools and is easy to perform.

While the invention has been illustrated and described in the drawings and the foregoing description, and alternate embodiments considered, the same are to be considered as an illustration and not restrictive in character, it being understood that the preferred embodiments have been described and all changes and modifications that are within the spirit of the invention are desired to be protected.

What is claimed is:

1. A laterally adjustable frame for supporting a pair of support rails upon which hanging folders may be suspended, which comprises:

first and second frame elements each having a column member and at least one substantially horizontal bracket member extending away from the column member;

means for positioning a pair of support rails at a height which enables suspension of file folders thereon; and means for adjustably connecting the first and second bracket members to position the column members in a spaced relation corresponding to a predetermined adjustable distance between the support rails positioning means, said adjustable connecting means comprising a plurality of apertures positioned in spaced relation along one of the horizontal bracket members and a plurality of locking elements positioned along the other horizontal bracket member, said locking elements positioned in spaced relation corresponding to the spaced relation of the apertures and wherein at least two locking elements engage two corresponding apertures to join said first and second frame elements to form said frame.

2. The frame of claim 1, wherein each of said locking elements comprises a first portion secured to the horizontal bracket member, and a second portion secured to the first portion, said second portion having at least one dimension which is larger than that of said first portion.

3. The frame of claim 2, wherein the larger dimension of the second portion of the locking elements passes into and engages the aperture.

4. The frame of claim 2, wherein each of said apertures is configured to have a first opening which receives both the first and second portions of the locking elements, and a second opening which has at least one dimension that is smaller than the second portions of the locking elements.

5. The frame of claim 4, wherein the first opening of each aperture is substantially circular and the second opening is an elongated slot, such that the second portion of the locking elements can pass through the first opening but will be retained behind the bracket member by the slot.

6. The frame of claim 4, wherein the first and second portions of the locking means are inserted substantially perpendicularly into the first opening and the second portion is placed into the second opening by relative linear movement of the bracket members.

7. The frame of claim 1, wherein each bracket member includes an elongated wall member having opposed ends and side portions, a flange member extending from each side portion and wherein one end of the wall member is secured to the column member.

8. The frame of claim 1, further comprising registration means for retaining the position of one horizontal bracket member with respect to the other in a predetermined spatial relation.

9. The frame of claim 8, wherein said registration means comprises a raised area associated with one of the horizontal bracket members, and a plurality of recesses associated with the other horizontal bracket member, said raised area capable of selectively engaging said recesses to provide different relative spatial positions of the column members.

10. The frame of claim 1, wherein each of said frame elements comprises a second substantially horizontal bracket member extending away from the column member and arranged in parallel spaced relation to the first bracket member for imparting increased rigidity to the connection of the frame elements.

11. The frame of claim 10, wherein the first horizontal bracket member is positioned at an upper end of the column member and the second horizontal bracket member is positioned at a lower end of the column member.

12. The frame of claim 10, which further comprises means operatively associated with the adjustable connecting means for releasably locking the second bracket members together.

13. The frame of claim 1, wherein the releasable locking means comprises a plurality of apertures positioned in spaced relation along one of the second horizontal bracket members and a plurality of locking elements positioned along the other second horizontal bracket member, said locking elements positioned in spaced relation corresponding to the spaced relation of the apertures and wherein at least two locking elements engage two corresponding apertures to releasably join said second bracket members together.

14. The frame of claim 1, wherein the bracket member and column member of each frame element is integrally formed and made of a plastic material.

15. The frame of claim 1, wherein each column member is provided with one or more reinforcing ribs for additional strength and rigidity.

16. The frame of claim 1, wherein the support rail positioning means comprises a channel located at an upper portion of the column member which channel has a length sufficient to retain a support rail in a substantially horizontal position when one end of the support rail is received by the channel.

17. The frame of claim 16 wherein each channel has an open end and a closed end and wherein one end of the support rail passes through the open end of the channel and is positioned adjacent the closed end.

18. The frame of claim 1 in combination with a pair of support rails.

19. The frame of claim 18 wherein each support rail is longitudinally adjustable and includes a plurality of rail elements.

20. A suspension system for hanging file folders which comprises first and second laterally adjustable frames each constructed according to claim 1 and a pair of support rails each having first and second ends, wherein the first ends of the rails are retained in the positioning means of the first frame and the second ends of the rails are retained in the positioning means of the second frame.

21. A suspension system for hanging file folders which comprises:

first and second laterally adjustable frames each including means for positioning a pair of support rails at a height which enables suspension of file folders thereon; and a pair of support rails each having first and second ends, wherein the first ends of the rails are retained in the positioning means of the first frame and the second ends of the rails are retained in the positioning means of the second frame, each of said rails comprising:

at least two rail elements, each substantially shorter than the total desired length of the support rail, each of said rail elements having a first end, a second end and elongated sides;

a rail element connecting bracket; and means for joining the second ends of the rail elements to the connecting bracket comprising a recess and a recess engaging component, wherein the recess is associated with one of the connecting bracket or the second end of the rail element, and the recess engaging component is associated with the other to form a support rail having a top surface which allows sliding movement of suspended file folders thereon.

22. The system of claim 21 wherein the connecting bracket comprises a pair of spaced elongated side walls attached by a base portion and retained in a substantially parallel arrangement for receiving the second ends of the rail elements in contact relation with a portion of the sides of the rail elements.

23. The system of claim 22 wherein the side walls of the connecting bracket include a ramp portion on each end thereof to facilitate sliding movement of the hanging file folders thereover in either direction without substantial obstruction.

24. The system of claim 22 wherein the second ends of the rail elements are retained in adjacent relation in linear alignment in the connecting bracket.

25. The system of claim 24 wherein each second end of the rail elements has an arm portion which extends toward the other rail element for mating engagement therewith to strengthen the support rail.

26. The system of claim 22 wherein each of the second ends of the rail elements includes a recess and at least one of the side walls of the connecting bracket includes a pair of spaced recess engaging components for lockingly engaging the recesses of the rail elements.

27. The system of claim 26 wherein the connecting bracket further includes an additional base portion for attaching the side walls together in the form of a sleeve.

28. The system of claim 27 wherein the connecting bracket is made of a single sheet of material which is shaped to have the desired configuration and the ends of which are joined for structural rigidity.

29. The system of claim 22 wherein the connecting bracket is releasably engagable with the second ends of the rail elements and is positioned so that the hanging file folders slide upon the base portion of the connecting bracket.

30. The system of claim 22 wherein the recess in each of the second ends of the rail elements is an aperture and each recess engaging component is a fastener which allows the rail elements to pivot with respect to the connecting bracket.

31. The system of claim 30 wherein the side walls of the connecting bracket have a length which is greater than the length of the base portion and the fasteners are located in the side walls at a point beyond the length of the base portion.

32. The system of claim 30 wherein the connecting bracket further includes means to prevent rotation of the rail elements by no more than about 90 degrees with respect to the connecting bracket.

33. The system of claim 30 wherein the connecting bracket is releasably engagable with the hat the hanging file folders slide upon the side walls of the connecting bracket and not upon the base portion.

34. The system of claim 20 wherein one of the ends of each support rail has at least one notch region for adjusting the length of the support rail.

35. The system of claim 21 wherein the first end of one of the rail elements of each support rail has at least one notch region for adjusting the length of the support rail.

36. A combination comprising the suspension system of claim 21 and a package for shipping the suspension system, said package having a length, width and height each of which is less than about one-half the length of a conventional hanging folder support rail, and wherein the frame elements are joined to form the frames and the rails are enclosed in the box as rail elements.

37. The combination of claim 36 wherein the length and width of the package, when multiplied, result in an area which is less than about 35% of that of a suspension system package which contains conventional support rails.

38. The combination of claim 36 wherein the frames include means for receiving and storing the rail elements therein.

39. The combination of claim 38 wherein the rail element receiving means of the frames receives and stores the rail elements along a diagonal direction between the length and width of the package.

40. The combination of claim 36 wherein the bracket member is permanently mounted on the second end of one of the rail elements and the length of the rail element with the mounted bracket member is substantially the same length as the other rail element.

* * * * *